US006357943B1

(12) United States Patent
Kuang

(10) Patent No.: US 6,357,943 B1
(45) Date of Patent: Mar. 19, 2002

(54) BALL-POINT PEN WITH CORRECTION SUPPLY

(76) Inventor: Wang Wei Kuang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/880,993

(22) Filed: Jun. 15, 2001

(51) Int. Cl.[7] ..... B05C 1/00
(52) U.S. Cl. ..... 401/17; 401/21; 401/34
(58) Field of Search ..... 401/17, 16, 18, 401/34, 19, 21, 20, 23, 25, 26

(56) References Cited

U.S. PATENT DOCUMENTS 2,571,620 A * 10/1951 Sala ..... 401/34
3,941,488 A * 3/1976 Maxwell ..... 401/17
4,213,717 A * 7/1980 Lin ..... 401/17
4,600,327 A * 7/1986 Guzman ..... 401/17

* cited by examiner

*Primary Examiner*—David J. Walczak
(74) *Attorney, Agent, or Firm*—A&J

(57) ABSTRACT

A ball-point pen with correction supply includes a tubular holder having an upper end formed with a neck provided with an inner circular flange and a circular recess above the circular flange, a correction fluid container having a lower end snugly-fitted into the circular recess and bearing against the circular flange, an upper tubular member configured to engage with the neck, a reservoir tube fitted within the tubular holder having an upper end extending through the circular flange to abut against a lower end of the correction fluid container, and a cap engageable with a lower end of the tubular holder and an upper end of the upper tubular member.

1 Claim, 5 Drawing Sheets

BALL-POINT PEN WITH CORRECTION SUPPLY

BACKGROUND OF THE INVENTION

1. Field of the Invention

This invention is related to a ball-point pen which can be used for writing as well as correcting what is wrong.

2. Description of the Prior Art

It has been found that the correction fluid is a useful and efficient tool for correcting what is wrong. However, the correction fluid sold on the marketplace is contained in a plastic bottle so that one must purchase and carry a bottle of correction fluid in addition to a writing implement thereby wasting money and making it inconvenient to use.

Therefore, it is an object of the present invention to provide a ball point pen with correction function which ray obviate and mitigate the above-mentioned drawbacks.

SUMMARY OF THE INVENTION

This invention is related to a ball point pen with correction supply.

It is the primary object of the present invention to provide a ball point pen with correction supply which includes a tubular holder having an upper end formed with a neck provided with an inner circular flange and a circular recess above the circular flange, a correction fluid container having a lower end snugly-fitted into the circular recess and bearing against the circular flange an upper tubular member configured to engage with the neck, a reservoir tube fitted within the tubular holder having an upper end extending through the circular flange to abut against a lower end of the correction fluid container, and a cap engageable with a lower end of the tubular holder and an upper end of the upper tubular member.

It is another object of the present invention to provide a ball-point pen with correction fluid which is simple in construction and low in cost.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
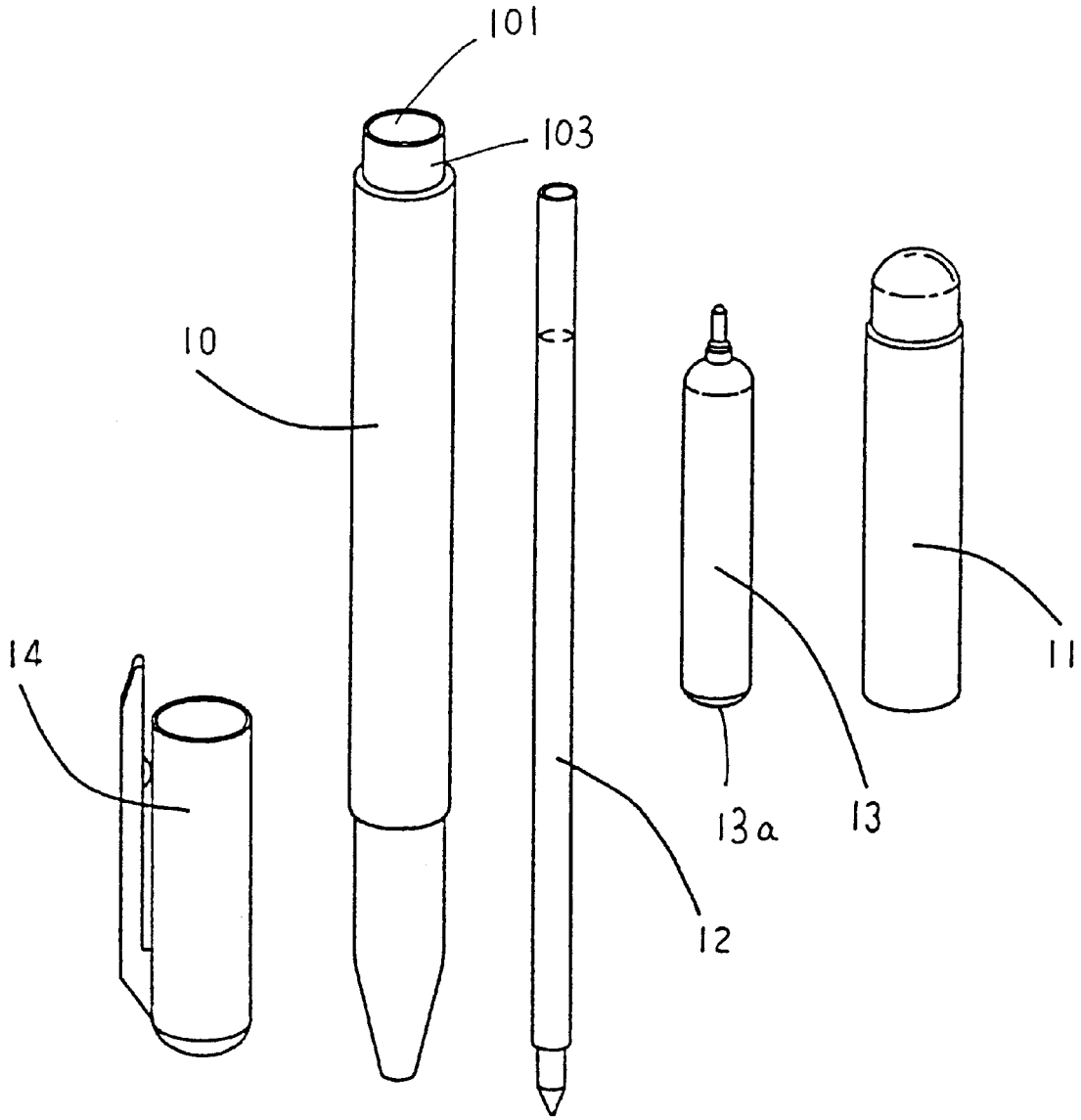
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
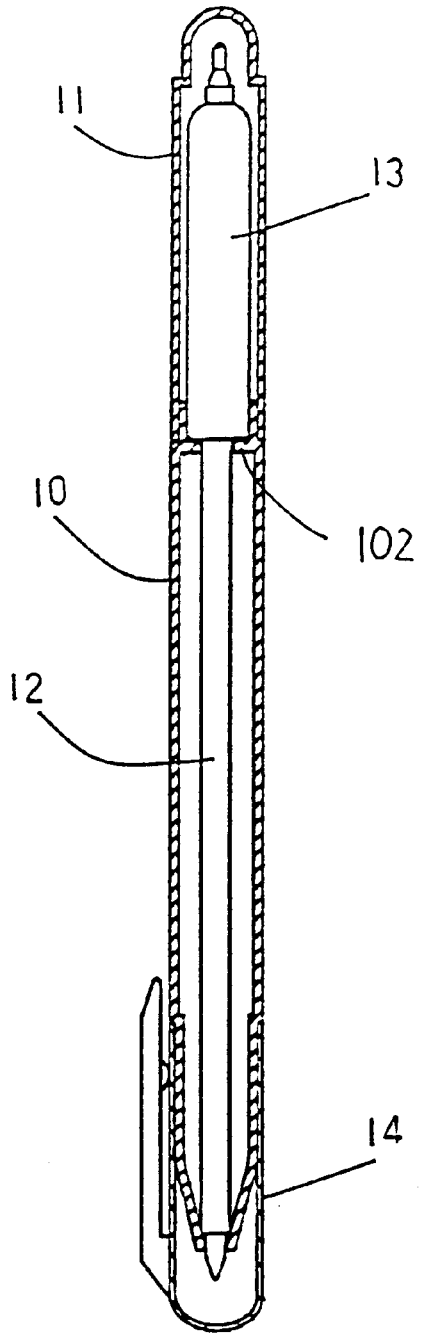
FIG. 2 is a sectional view of the present invention.
Figure 3:
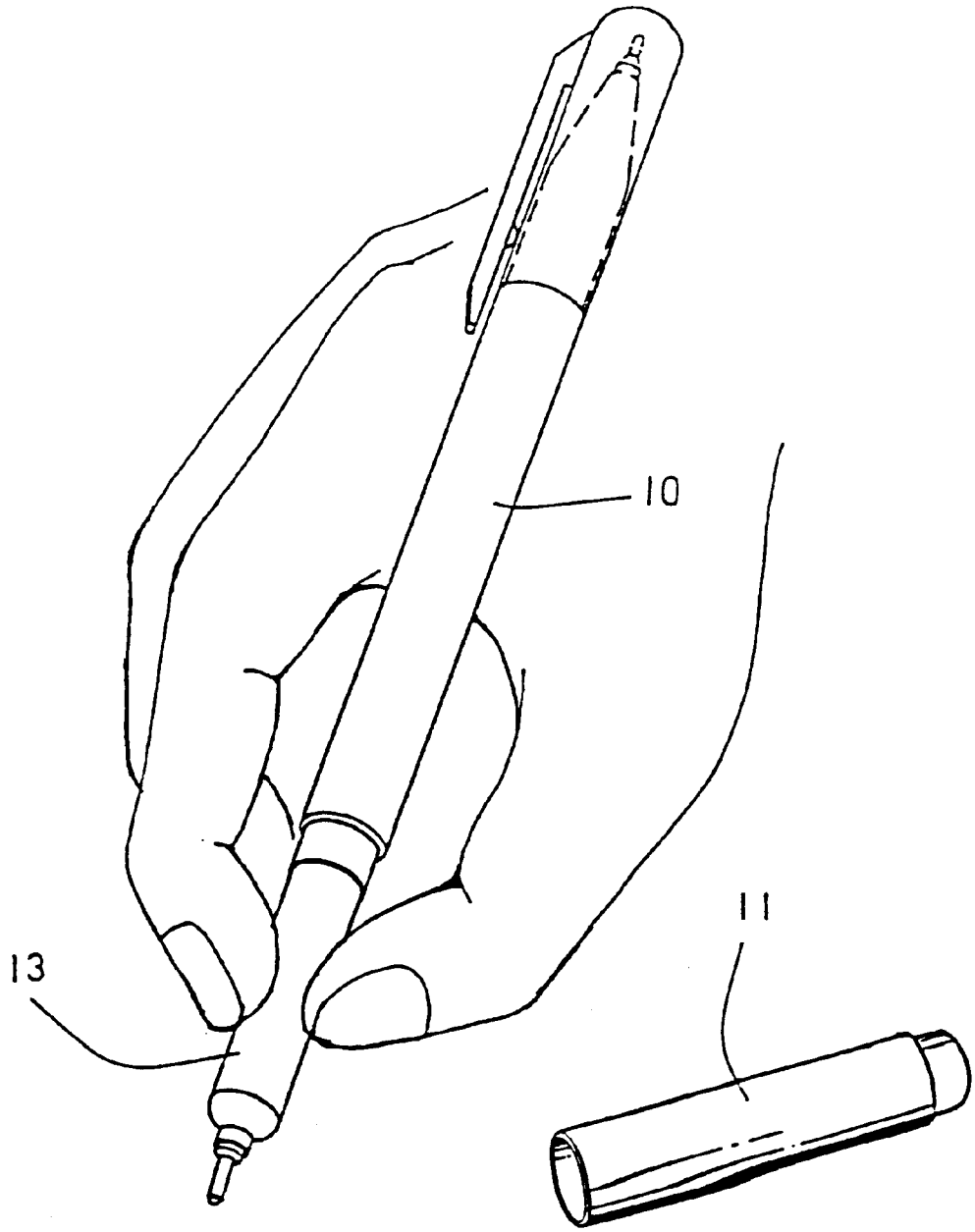
FIG. 3 is a working view of the present invention.

Referring to FIGS. 1 and 2 thereof, the ball-point pen with correction supply according to the present invention generally comprises a tubular holder 10, an upper tubular member 11, a reservoir tube 12, a cap 14, and a correction fluid container 13. The tubular holder 10 is formed with a neck 103 at the upper end which is formed with an inner circular flange 102 and a circular recess 101 above the circular flange 102. The lower end 13*a* of the correction fluid container 13 is snugly-fitted into the circular recess 101 and bears against the circular flange 102. The reservoir tube 12 is fitted within the tubular holder 10, with its upper end extending through the circular flange 102 to abut against the lower end of the correction fluid container 13. The lower end of the upper tubular member 11 is engaged with the neck 103 of the tubular holder 10. The cap 14 is engageable with the lower end of the tubular holder 10 and an upper end of the upper tubular member 11. When the present invention is used for writing, the correction fluid container 13 is kept within the upper tubular member 11. When desired to use present invention for correction, the upper tubular member 11 is removed and then the correction fluid container 13 is squeezed to discharge correction fluid for correction (see FIG. 3).

Figure 4:
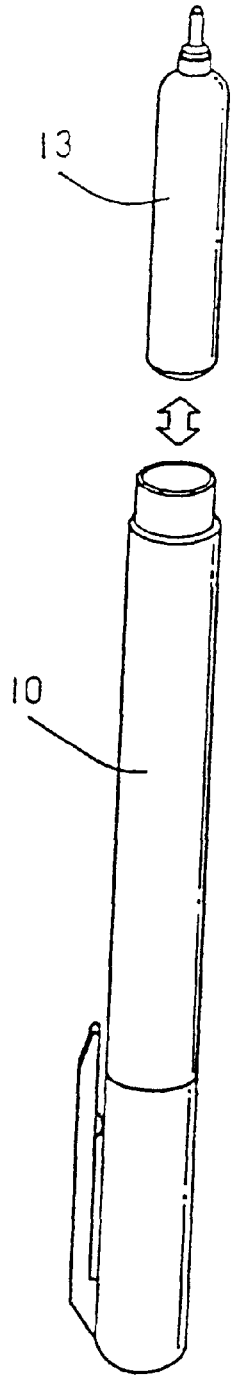
FIG. 4 illustrates how to replace the correction fluid container.

Referring to FIG. 4, the lower end of the correction fluid container 13 is snugly fitted into the upper end of the tubular holder 10 and so it can be replaced with a new one as required.

Figure 5:
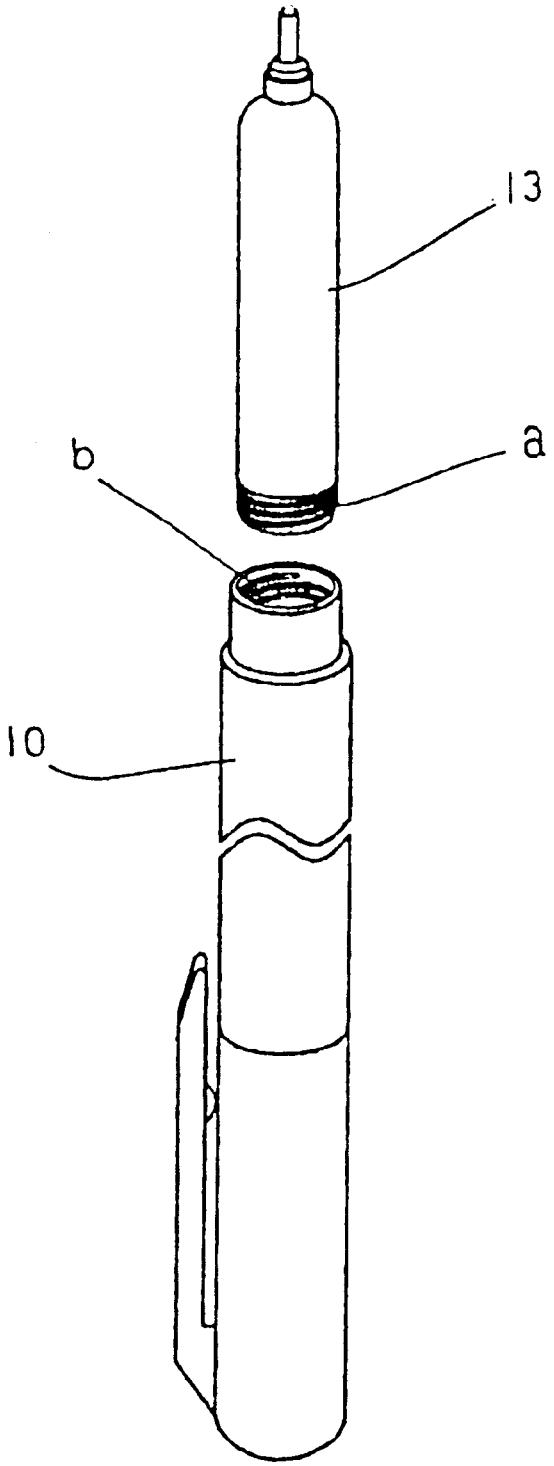
FIG. 5 illustrates a second preferred embodiment of the present invention.

FIG. 5 illustrates a second preferred embodiment of the present invention. As shown, the neck 103 of the tubular holder 10 is formed with internal threads b and the lower end of the correction fluid container 13 has external threads a which are adapted to engage with the threads b.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A ball-point pen with correction supply comprising:

a tubular holder having an upper end formed with a neck provided with an inner circular flange and a circular recess above said circular flange;

a correction fluid container having a lower end snugly-fitted into said circular recess and bearing against said circular flange an upper tubular member configured to engage with said neck;

a reservoir tube fitted within said tubular holder having an upper end extending through said circular flange to abut against a lower end of said correction fluid container; and a cap engageable with a lower end of said tubular holder and an upper end of said upper tubular member.

* * * * *